US011193396B2

(12) United States Patent
Biermann et al.

(10) Patent No.: US 11,193,396 B2
(45) Date of Patent: Dec. 7, 2021

(54) MODULE FOR A VARIABLE-STROKE VALVE DRIVE OF AN INTERNAL COMBUSTION ENGINE

(71) Applicant: Schaeffler Technologies AG & Co. KG, Herzogenaurach (DE)

(72) Inventors: Andreas Biermann, Fürth (DE); Benedikt Noe, Nuremberg (DE); Martin Steigerwald, Herzogenaurach (DE); Michael Pribek, Uehlfeld (DE); Frank Himsel, Obermichelbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/456,030

(22) Filed: Jun. 28, 2019

(65) Prior Publication Data

US 2020/0011212 A1 Jan. 9, 2020

(30) Foreign Application Priority Data

Jul. 3, 2018 (DE) ..... 10 2018 116 070.4

(51) Int. Cl.
*F01L 1/18* (2006.01)
*F01L 1/20* (2006.01)
*F01L 13/00* (2006.01)

(52) U.S. Cl.
CPC ..... *F01L 1/185* (2013.01); *F01L 1/181* (2013.01); *F01L 1/20* (2013.01); *F01L 13/0005* (2013.01);
(Continued)

(58) Field of Classification Search
CPC ..... F01L 1/20; F01L 1/181; F01L 1/18; F01L 1/12; F01L 1/185; F01L 2001/186; F01L 13/0005; F01L 13/0036; F01L 2105/00
(Continued)

(56) References Cited

U.S. PATENT DOCUMENTS 5,623,897 A * 4/1997 Hampton ..... F01L 13/0005 123/90.16
5,690,066 A * 11/1997 Hampton ..... F02D 13/06 123/90.16
(Continued)

FOREIGN PATENT DOCUMENTS

CN 110847995 A 2/2020
DE 2753197 A1 * 6/1978 ..... F01L 1/185
(Continued)

OTHER PUBLICATIONS

DE-2753197 English Language Machine Translation (Year: 1978).*

*Primary Examiner* — Patrick Hamo
*Assistant Examiner* — Wesley G Harris

(57) ABSTRACT

A pre-assembled module for a variable-stroke valve drive of an internal combustion engine is provided. The module includes a base plate having at least one projecting guide plate, an e-linear actuator positioned on the projecting guide plate, and a longitudinally guided push rod with two adjusting fingers extending along a wall of the guide plate. Each respective adjusting finger has a contact surface for displacement of a transverse coupling slide of a switchable cam follower. A rocker arm, having first and second arms, is suspended on an underside of the base plate; the first arm in contact with an adjusting pin of the linear actuator; and, the second arm in contact with the push rod for displacement thereof in a first direction. A spring means for displacement of the push rod in a second direction is arranged between the push rod and the guide plate.

20 Claims, 3 Drawing Sheets

(52) U.S. Cl.
CPC ... *F01L 2001/186* (2013.01); *F01L 2013/101* (2013.01); *F01L 2303/00* (2020.05)

(58) Field of Classification Search
USPC ..... 123/90.16, 198 F, 90.39, 90.44
See application file for complete search history.

(56) References Cited

U.S. PATENT DOCUMENTS

| | | | | |
|---|---|---|---|---|
| 10,352,201 | B2 * | 7/2019 | Okamoto | F01L 1/18 |
| 2003/0111031 | A1 * | 6/2003 | Hendricksma | F01L 1/267<br>123/90.15 |
| 2007/0266973 | A1 * | 11/2007 | Lancefield | F01L 1/146<br>123/90.16 |
| 2018/0363518 | A1 * | 12/2018 | Raimondi | F01L 13/0036 |

FOREIGN PATENT DOCUMENTS

| | | | | |
|---|---|---|---|---|
| DE | 102015002982 | A1 * | 9/2016 | F01L 1/12 |
| DE | 102017101792 | A1 | 8/2018 | |
| DE | 102017129553 | A1 * | 6/2019 | F01L 1/18 |
| DE | 102018112811 | A1 | 12/2019 | |

* cited by examiner

MODULE FOR A VARIABLE-STROKE VALVE DRIVE OF AN INTERNAL COMBUSTION ENGINE

CROSS-REFERENCE TO RELATED APPLICATIONS

This application claims priority under 35 U.S.C. Section 119 of German Patent Application No. DE 10 2018 116 070.4 filed Jul. 3, 2018, the disclosure of which is incorporated herein by reference.

TECHNICAL FIELD

This disclosure relates to a module for a variable-stroke valve drive of an internal combustion engine. The module has a push rod acted upon by an e-linear actuator to move in a first direction. Adjusting fingers project from the push rod, each adjusting finger having, on a portion remote from the push rod, a contact surface for displacement of a transverse coupling slide of a switchable cam follower. A spring means for displacement of the push rod in a second direction is fitted on the module.

BACKGROUND

A module of this type, having a push rod acted upon by an actuator and adjusting fingers on said push rod, is meanwhile also known as an e-rocker module. An example of this is revealed in DE 10 2017 101 792. In the cylinder head, a common push rod with an e-actuator at the end is associated with a row of outlet valves of a 3-cylinder internal combustion engine. Two identically acting gas exchange valves are provided for each cylinder. When the actuator is not energized, resetting of the push rod takes place via the force of a pressure spring arranged in the vicinity of the actuator.

The components of the above-mentioned "long" module have to be assembled on the cylinder head in a complex manner and are customized for the respective internal combustion engine type. For this, the cylinder head has slots for guiding the push rod in the portion of the camshaft bearing, through which slots the comparatively long, delicate push rod, which is difficult to handle, has to be guided during assembly, with subsequent assembly of the push fingers on said push rod. In this case, the e-actuator is located flush behind the push rod and increases the installation space of the internal combustion engine unnecessarily, moreover needing to be fastened separately.

It has also been established that simultaneous actuation of the row of gas exchange valves has a high power requirement and that only a small time window is available in this regard. Moreover, a comparatively strong resetting spring means has to be fitted. Internal combustion engines with a cylinder number greater than three are also quite clearly a possibility.

The object is to create module a which is easy to construct and assemble and can be used in a versatile manner.

SUMMARY

According to the disclosure, this object is achieved by the novel features described herein.

Accordingly, this relates to an "externally" pre-assembled module for installation in a cylinder head of the internal combustion engine. The module has a base plate with at least one projecting guide plate, on which base plate the e-linear actuator is positioned head first, wherein the longitudinally guided push rod with merely one or two projecting adjusting fingers extends along a wall of the guide plate. Suspended on an underside of the base plate is a rocker arm whereof a first arm is in contact with an adjusting pin of the linear actuator, the adjusting pin penetrating the base plate, and a second arm is in contact with the push rod for displacement thereof in a first direction. The spring means for displacement of the push rod in a second direction is fitted on the module and clamped at least indirectly between the push rod and the base plate or guide plate.

A module without the above-mentioned disadvantages is therefore provided. The now compact module for actuating one or two switching cam followers (inlet or outlet row) of only one cylinder of the internal combustion engine (three switching cam followers are furthermore conceivable) can be supplied to the internal combustion engine fully pre-assembled externally and assembled there "from above" in an automated manner or manually. The transportation and handling thereof are comparatively simple. The person skilled in the art will recognize that this module can now be used universally across a wide range of internal combustion engine types. It is also possible to only partially equip a cylinder head with the modules. It is moreover clear that the single module has a comparatively low energy requirement with a sufficiently large switching time window.

According to one embodiment of the disclosure, the base plate supporting the functional elements of the module and having the projecting guide plate is made from thin-walled steel sheet and is produced in a punching and bending technique. In this case, the base plate can constitute two simple longitudinal strips, for example, at the center of which the actuator is vertically fastened. To fasten the base plate to the cylinder head, the longitudinal strips have, for example, bores at their ends. These longitudinal strips can be screwed to suitable contact points of the cylinder head, such as camshaft bearing caps, parallel to the camshaft or to the longitudinal wall of the internal combustion engine, via said bores.

As is moreover proposed, a guide plate can be positioned opposite and parallel to the base plate, which guide plate likewise projects from the base plate in a single part. This creates a simple fastening option for a shaft, formed as a peg, for the rocker arm. Alternatively, the rocker arm can also be mounted on two eyes/lugs suspended from the base plate, or only on one side.

The flexible adjusting fingers, which are made from spring steel, can be present as components which are separately joined to the push rod. This refers to simply suspending them on the push rod via portions bent at right angles, or the like, which are constructed thereon. However, it is also conceivable and provided for the adjusting fingers to possibly be constructed as a single-part component of the push rod.

A simple contact point for the rocker arm on the push rod is provided via a tab which, according to the proposal, protrudes from the push rod in a single part and with which the second arm of the rocker arm which is remote from the actuator is in contact. The lug can simply stand out from the push rod. Alternatively, separate contact bodies, such as a screw, a peg, a block or the like, are possible.

An "internal" guidance of the push rod along the module is also provided. Accordingly, a holding plate is seated on a wall of the guide plate. The push rod is longitudinally guided in a slot between these components. Both plates can be connected to one another by pegs, for example, on which the push rod is guided by means of an elongated hole.

It is likewise provided to integrate the resetting means for the push rod in the module. For this, according to a sub-variant of the disclosure, an arm protrudes from the above-mentioned holding plate, between which arm and a bracket of the push rod a helical pressure spring or a helical pressure spring assembly is clamped. Alternatively, the resetting procedure can also take place electromagnetically or otherwise via a servo means.

The respective adjusting finger has a twisting geometry and is therefore neatly guided in the confined cylinder head region to the respective switching cam follower.

DETAILED DESCRIPTION

Figure 1:
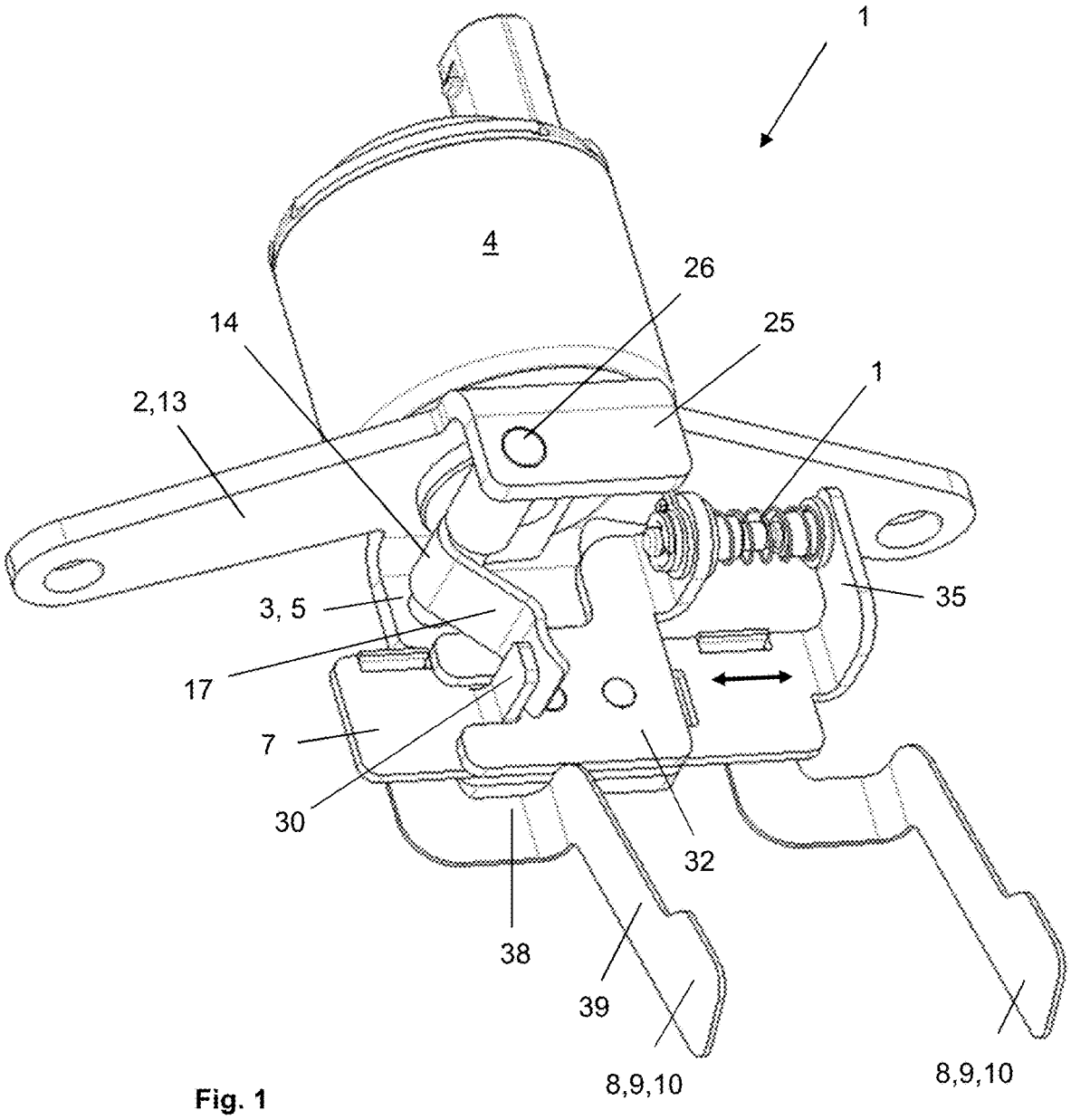
FIG. 1 shows a three-dimensional front view of the module.

A compact module 1 for a variable-stroke valve drive of an internal combustion engine is illustrated in the figures. The module 1, with all the components described below fully pre-assembled thereon, is supplied to the cylinder head 6 of the internal combustion engine and screw-connected there.

The module 1 has a base plate 2 made from steel sheet, from which a guide plate 3 is bent away. The base plate 2 ultimately consists of two strips running towards one another in the manner of wings (see in particular FIG. 2), at the ends 19, 20 of which a respective joining point 21, 22 designed as a bore is located. Via the joining points 21, 22, the module 1 is fixedly screw-connected to supporting regions 24 located near to camshaft bearing caps 23 of the cylinder head 6. The module 1 therefore extends parallel to the longitudinal extent of the cylinder head 6.

Figure 2:
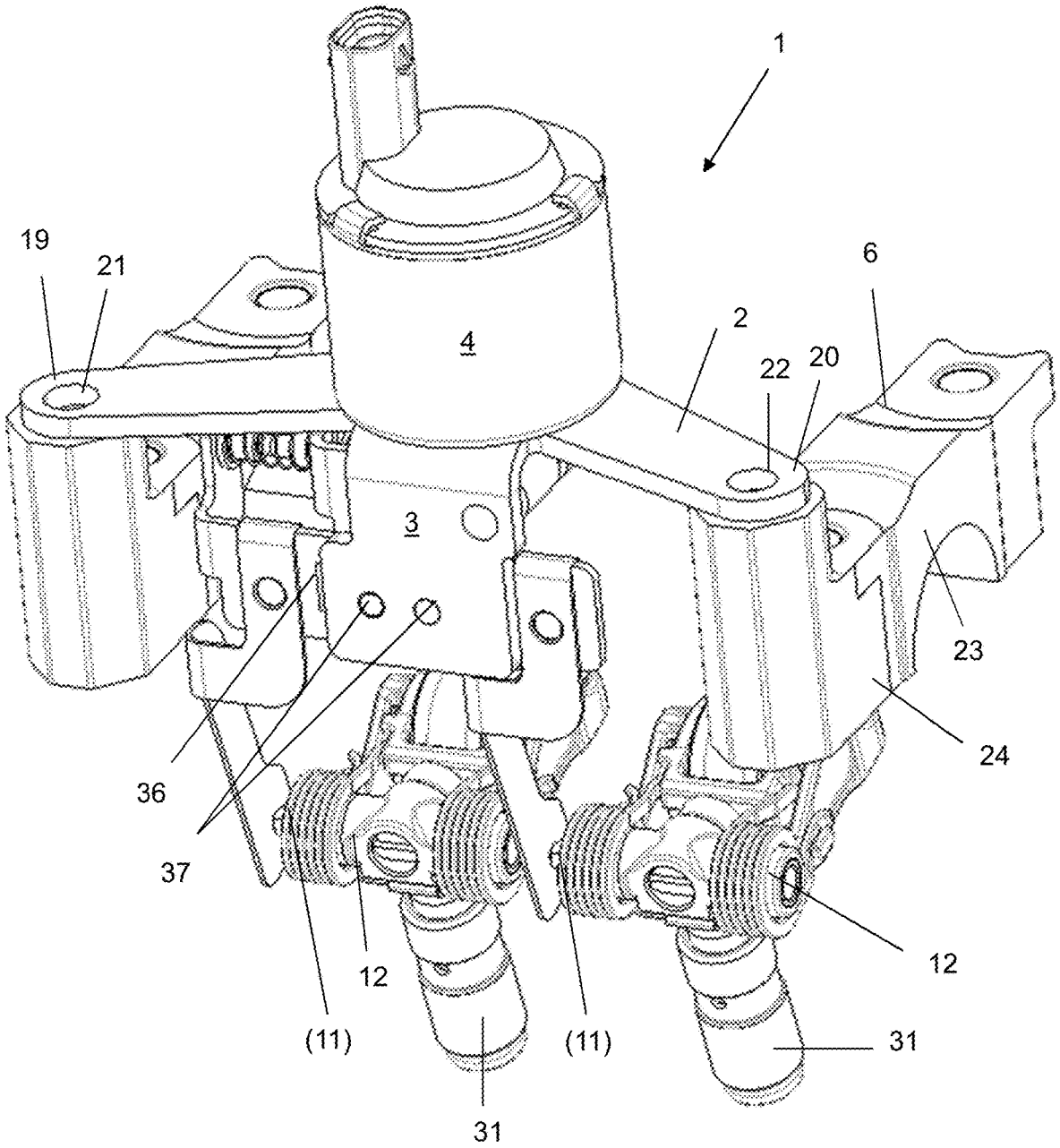
FIG. 2 shows the module installed in the cylinder head.

As revealed in FIGS. 1, 2, an e-linear actuator 4 belongs to the module 1, which e-linear actuator is positioned centrally on the guide plate 3, head first, and projects with its adjusting pin 16 through the base plate 2.

A push rod 7 made from steel sheet is guided along the previously mentioned guide plate 3 of the base plate 2 in the longitudinal direction of the cylinder head 6. In principle, the push rod 7 has a plate-like geometry. Two mutually spaced adjusting fingers 8 made from spring steel are suspended in the push rod 7. These extend along an outer wall of the push rod 7 and, via a portion bent at right angles 29, are seated in a pocket 27 of an upper longitudinal side 28 of the push rod 7.

As revealed in FIG. 1, below the push rod 7, the respective adjusting finger 8 merges into a first extension 38 which is angled parallel to the push rod and from which a hook-like end piece 39 (portion 9 remote from the push rod) with a contact surface 10 for a transverse coupling slide 11 of a switchable cam follower 12 protrudes in an upwardly bent manner. The compact module 1 is therefore associated with merely two identically acting gas exchange valves of a cylinder of the internal combustion engine.

Figure 3:
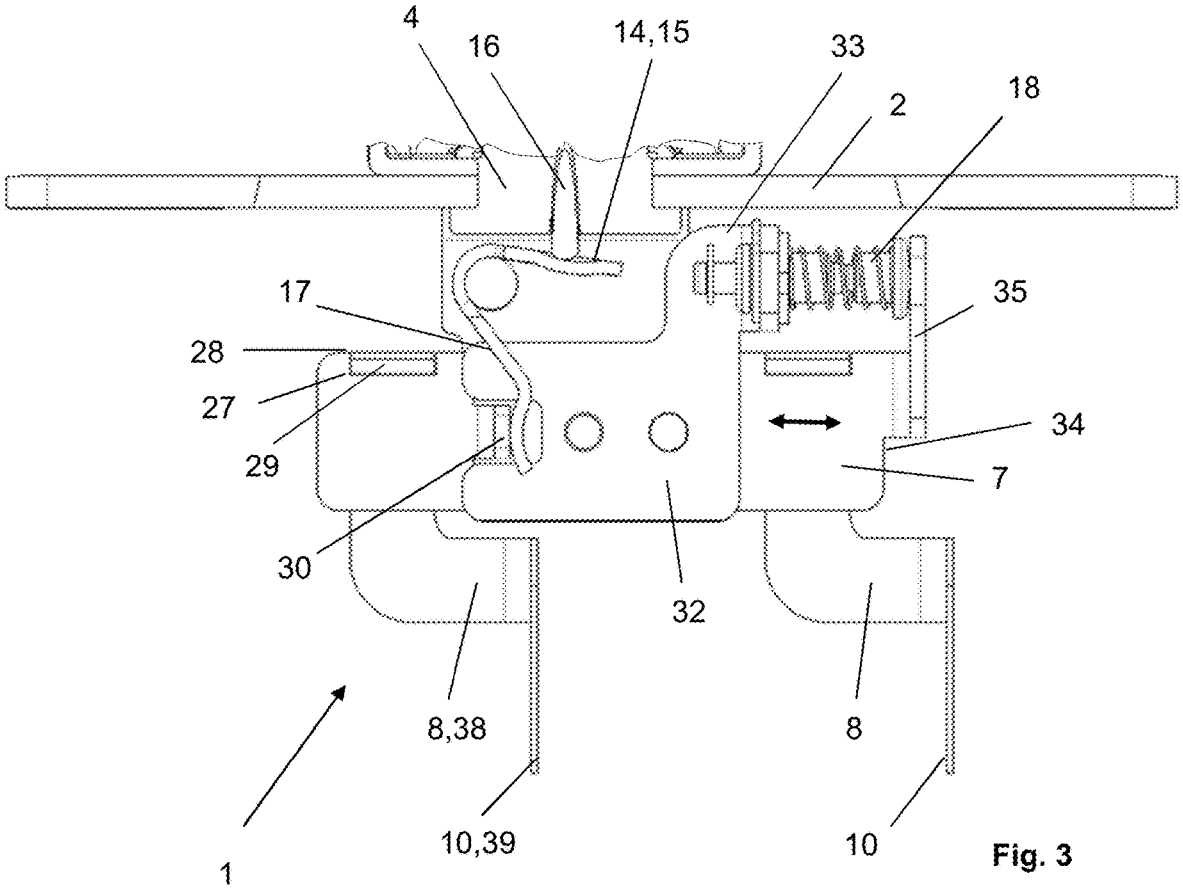
FIG. 3 shows a side view of the module.

An angular rocker arm 14 made from steel sheet is suspended on an underside 13 of the base plate 2 (see FIGS. 1, 3). For this, a holding plate 25 is positioned opposite and parallel to the guide plate 3 of the base plate 2. The plates 2, 25 are bridged by a peg 26 fastened herein, on which the rocker arm 14 is mounted. As is clearly shown in FIG. 3, a first arm 15 of the rocker arm 14 is contacted by the adjusting pin 16 of the linear actuator 4. A second arm 17 of the rocker arm 14 acts on a tab 30 of the push rod 7 for displacement thereof in one direction ("coupling direction" from right to left here).

Energization of the actuator 4, for example at the start of a predetermined coupling time window for the transverse coupling slides 11 of the two cam followers 12, would result in a downward extension of the adjusting pin 16 of said linear actuator, whereby the rocker arm 14 would execute a segmental rotation in the clockwise direction. Consequently, the push rod 7 with its downwardly suspended adjusting fingers 8 would ultimately be displaced to the left and the adjusting fingers 8, subject to passage of the cam base circle, would displace the transverse coupling slides 11 of the cam followers 12, whereby, depending on the configuration, either a coupling or an uncoupling of the two lever parts of the cam follower 12 would be achieved, which does not need to be described in more detail at this point.

The above-mentioned translatory guidance of the push rod 7 on the module 1 takes place, more precisely, in a slot between the guide plate 3 and a holding plate 32 which is fixedly connected to the guide plate 3 and is likewise made from steel sheet. The push rod 7 has an elongated hole 36 which can be seen in FIG. 2 and in which at least one peg 37 connecting the guide and holding plate 3, 32 runs.

An arm 33 projects upwardly at an angle from the holding plate 32, a bracket 35, which likewise protrudes away from an end 34 of the push rod 7 which is remote from the rocker arm, being positioned opposite said arm 33 (see FIG. 3). In the case of a de-energized or slightly energized e-linear actuator 4, a spring means 18 designed as a helical pressure spring for resetting the push rod 7 is clamped between said arm and said bracket.

It is clear that, in the desired displacement situation, owing to the spring effect of the adjusting fingers 8, these can "pre-tension" the respective transverse coupling slide 11 in the cam follower 12 outside or prior to passage of the cam base circle, with a "sudden" retraction of the respective transverse coupling slide 11 into the cam follower 12 occurring at the start of the base circle.

LIST OF REFERENCE CHARACTERS

1 Module
2 Base plate
3 Guide plate, plate
4 e-linear actuator, actuator
5 Wall
6 Cylinder head
7 Push rod
8 Adjusting finger
9 Portion
10 Contact surface
11 Transverse coupling slide
12 Cam follower
13 Underside
14 Rocker arm
15 First arm
16 Adjusting pin
17 Second arm
18 Spring
19 End
20 End
21 Joining point
22 Joining point
23 Camshaft bearing cap

24 Region
25 Holding plate, plate
26 Peg
27 Pocket
28 Longitudinal side
29 Portion bent at right angles
30 Tab
31 Supporting element
32 Holding plate
33 Arm
34 End
35 Bracket
36 Elongated hole
37 Peg
38 Extension
39 End piece

The invention claimed is:

1. A pre-assembled module for a variable-stroke valve drive of an internal combustion engine, comprising:

a base plate having at least one projecting guide plate, an actuator arranged on the at least one projecting guide plate, a longitudinally guided push rod having:

a first adjusting finger configured to displace a first transverse coupling slide of a first switchable cam follower, and a second adjusting finger configured to displace a second transverse coupling slide of a second switchable cam follower, the second switchable cam follower arranged adjacently to the first switchable cam follower, and the first adjusting finger configured to extend between a first longitudinal side of the first switchable cam follower and a second longitudinal side of the second switchable cam follower, a spring arranged between the longitudinally guided push rod and the base plate or the at least one projecting guide plate, the spring configured to displace the longitudinally guided push rod in a first direction, and a rocker arm having:

a first arm in contact with an adjusting pin of the actuator, the adjusting pin penetrating the base plate, and a second arm in contact with the longitudinally guided push rod, the second arm configured to displace the longitudinally guided push rod in a second direction.

2. The pre-assembled module as claimed in claim 1, wherein the base plate and the at least one projecting guide plate are formed from a single part, the base plate comprising two strips running towards one another, and having a contact center at which the actuator is positioned, and joining points are provided at free ends of the strips.

3. The pre-assembled module as claimed in claim 1, wherein a holding plate is positioned opposite and parallel to the at least one projecting guide plate, the holding plate projecting from the base plate, and the holding plate and the at least one projecting guide plate connected by a peg on which the rocker arm is mounted.

4. The pre-assembled module as claimed in claim 1, wherein a longitudinal displacement path of the longitudinally guided push rod is configured to be parallel to a displacement path of the first transverse coupling slide of the first switchable cam follower.

5. The pre-assembled module of claim 1, wherein at least one of the first or second adjusting fingers is a separately joined component to the longitudinally guided push rod, the at least one of the first or second adjusting fingers guided outwards along a wall of the longitudinally guided push rod, and, via a portion bent at right angles, is seated in a pocket of an upper longitudinal side of the longitudinally guided push rod.

6. The pre-assembled module as claimed in claim 1, wherein a tab protrudes from the longitudinally guided push rod, the tab contacted by the second arm of the rocker arm for actuator-induced displacement of the longitudinally guided push rod.

7. The pre-assembled module as claimed in claim 1, wherein the longitudinally guided push rod is guided in a slot arranged between a wall of the at least one projecting guide plate and a holding plate fixedly connected to the at least one projecting guide plate.

8. The pre-assembled module as claimed in claim 7, wherein the longitudinally guided push rod has an elongated hole within which at least one peg connecting the at least one projecting guide plate and holding plate runs through.

9. The pre-assembled module as claimed in claim 7, wherein:

an arm projects at an angle from the holding plate;

a bracket projects from an end of the longitudinally guided push rod; and, the spring is arranged between the arm and the bracket.

10. The pre-assembled module as claimed in claim 1, wherein the first arm and the second arm are formed from a single part.

11. A module for a variable-stroke valve drive of an internal combustion engine, comprising:

a base plate;

an actuator secured to the base plate;

a push rod having a longitudinal displacement path, a plate-shaped portion of the push rod disposed within and slidably guided by a slot formed between: i) a first wall of the base plate, and ii) a second wall of a holding plate fixedly connected to the base plate; and, the push rod having a contact surface configured to contact a transverse coupling slide of a switchable cam follower; and a rocker arm having:

a first arm in contact with an adjusting pin of the actuator; and, a second arm in contact with the push rod; and, an extension of the adjusting pin configured to rotate the rocker arm and displace the push rod within the slot.

12. The module of claim 11, further comprising a spring clamped between an arm of the holding plate and a bracket of the push rod.

13. The module of claim 12, wherein am extension pathway of the adjusting pin orthogonal to a displacement pathway of the push rod.

14. The module of claim 11, wherein the push rod includes at least one adjusting finger configured with the contact surface.

15. The module of claim 11, wherein the push rod further comprises an elongated hole, and at least one peg configured to fixedly connect the holding plate to the base plate extends through the elongated hole.

16. The module of claim 14, wherein the at least one adjusting finger is configured to pre-tension the transverse coupling slide when the switchable cam follower is engaged with a portion of a camshaft outside of base circle.

17. The module of claim 11, wherein the first arm is directly engaged with the adjusting pin of the actuator.

18. The module of claim 11, wherein the extension of the adjusting pin rotates the rocker arm so that the second arm moves a tab formed on the push rod, the tab extending transversely from a longitudinal side of the plate-shaped portion of the push rod.

19. A variable-stroke valve drive of an internal combustion engine, comprising:

a switchable cam follower;

a module having:

a base plate having a first portion configured to be secured to a cylinder head of an internal combustion engine, and a second portion arranged transversely to the first portion;

an actuator secured to the first portion of the base plate;

a holding plate fixedly connected to and offset from the second portion of the base plate such that a slot is formed between a first flat side of the holding plate and a second flat side of the second portion, a push rod disposed within and slidably guided by the slot, the push rod having a contact surface configured to contact and linearly displace a coupling slide of the switchable cam follower, and a longitudinal displacement path of the push rod is parallel to a displacement path of the coupling slide;

a spring clamped between the holding plate and the push rod, a rocker arm having:

a first arm in contact with an adjusting pin of the actuator; and, a second arm in contact with the push rod; and, an extension of the adjusting pin configured to rotate the rocker arm and linearly displace the push rod in a first direction within the slot, and the spring configured to move the push rod in a second direction, opposite the first direction, within the slot.

20. The variable-stroke valve drive of claim 19, wherein the push rod further comprises an adjusting finger having the contact surface, the adjusting finger configured to pre-tension the coupling slide when the switchable cam follower is engaged with a portion of a camshaft outside of base circle.

* * * * *